US008343367B2

(12) United States Patent
Choi et al.

(10) Patent No.: US 8,343,367 B2
(45) Date of Patent: Jan. 1, 2013

(54) METHOD FOR FORMING CONTINUOUS CHANNEL OF THE SURFACE OF CASTING ROLL FOR THE TWIN ROLL STRIP CASTING PROCESS

(75) Inventors: Ju-Tae Choi, Buk-gu Pohang-si (KR); Man-Jin Ha, Nam-gu Pohang-si (KR); Hee-Kyung Moon, Nam-gu Pohang-si (KR)

(73) Assignee: POSCO, Pohang-Si, Gyeongsangbuk-Do (KR)

( * ) Notice: Subject to any disclaimer, the term of this patent is extended or adjusted under 35 U.S.C. 154(b) by 468 days.

(21) Appl. No.: 12/375,837

(22) PCT Filed: Jul. 26, 2007

(86) PCT No.: PCT/KR2007/003585

§ 371 (c)(1),
(2), (4) Date: Jan. 30, 2009

(87) PCT Pub. No.: WO2008/016231

PCT Pub. Date: Feb. 7, 2008

(65) Prior Publication Data

US 2010/0000968 A1 Jan. 7, 2010

(30) Foreign Application Priority Data

Aug. 2, 2006 (KR) ..... 10-2006-0073089

(51) Int. Cl.
*C03C 15/00* (2006.01)

(52) U.S. Cl. ..... 216/41; 216/57; 216/83

(58) Field of Classification Search ..... 156/501
See application file for complete search history.

(56) References Cited

U.S. PATENT DOCUMENTS

| | | | | |
|---|---|---|---|---|
| 6,331,376 | B1 * | 12/2001 | Kojima et al. | 430/284.1 |
| 2002/0094488 | A1 * | 7/2002 | Imai et al. | 430/270.1 |

FOREIGN PATENT DOCUMENTS

| | | | |
|---|---|---|---|
| JP | 02-295647 | | 12/1990 |
| JP | 05-185327 | | 7/1993 |
| JP | 11-179494 | * | 7/1999 |
| KR | 10-1999-0051836 | A | 7/1999 |
| KR | 2000-0040609 | * | 7/2000 |

* cited by examiner

*Primary Examiner* — Lan Vinh
*Assistant Examiner* — Jiong-Ping Lu
(74) *Attorney, Agent, or Firm* — Finnegan, Henderson, Farabow, Garrett & Dunner, LLP

(57) ABSTRACT

Disclosed is a method of forming a continuous channel for gas discharge in the surface of a casting roll for twin roll strip casting, and particularly, a method of forming a continuous channel for gas discharge on the surface of a casting roll for twin roll strip casting, suitable for the formation of dimples on the surface of a casting roll for a twin roll strip caster, which includes applying a photoresist on the entire surface of a casting roll, conducting patterning on the applied photoresist, developing the surface of the casting roll, subjected to the patterning, and etching the metal surface of the casting roll, exposed in the developing, and which prevents the generation of dents, enables the manufacture of a cast product having no defects, and realizes wide applicability not only to high Mn steel but also to types of casting steel capable of generating dents or similar defects due to a large amount of volatile gas.

1 Claim, 4 Drawing Sheets

–Prior Art–

–Prior Art–

Fig. 3 −Prior Art−

| Surface Shape | Independent Dimple | | | | Continuous Channel |
|---|---|---|---|---|---|
| Process | Photo-etching | Shot blasting | Photo-etching + shot blasting | Shot blasting + laser processing | Photo-etching/ Laser patterning etching |
| Surface shape | | | | | |
| Surface shape of cast product | 500μm Surface Shape | | 200μm Section Shape of Dent | 3D Shape of Dent | |
| Generation of dent(s) | Yes | Yes | Yes | Yes | No |

METHOD FOR FORMING CONTINUOUS CHANNEL OF THE SURFACE OF CASTING ROLL FOR THE TWIN ROLL STRIP CASTING PROCESS

TECHNICAL FIELD

The present invention relates to a method of forming a continuous channel for gas discharge on the surface of a casting roll for twin roll strip casting, and more particularly, to a method of forming a continuous channel for gas discharge on the surface of a casting roll for twin roll strip casting, suitable for the formation of dimples in the surface of a casting roll for a twin roll strip caster, which includes applying a photoresist on the entire surface of a casting roll, conducting patterning on the applied photoresist, developing the surface of the casting roll, which is subjected to the patterning, and etching the metal surface of the casting roll, exposed in the course of the developing, and which prevents the generation of dents, enables the manufacture of a cast product having no defects, and realizes wide applicability not only to high Mn steel but also to types of casting steel capable of generating dents or similar defects due to a large amount of volatile gas.

BACKGROUND ART

As illustrated in FIG. 1, in a general twin roll strip caster 100, molten steel in a tundish 103 is supplied between two casting rolls 101 and an edge dam 102 attached to opposite surfaces thereof via an immersion nozzle 104, to form molten steel pool 105, and the casting rolls 101 are rotated in opposite directions relative to each other such that the molten steel is brought into contact with the rolls to thus transfer heat into the rolls, thereby rapidly solidifying the molten steel, by which a cast product 106 is manufactured.

In the strip caster 100 for manufacturing the cast product 106, the shape of the surface of the roll is regarded as very important, and the related technique is the core of the strip casting process for manufacturing a cast product having no defects. Generally, in the case where liquid metal is solidified to a solid phase, internal stress, including solidification contraction force and transformation stress, is generated. In particular, in the case where solidification occurs at a high cooling rate, as in the strip casting process, there is a very high probability of surface cracks being created in the cast product, attributable to the increase in such internal stress. Thus, in the strip casting process, a technique for imparting the surface of the casting roll with roughness to effectively disperse and eliminate the internal stress is typically known.

When subjecting general steel to strip casting along with austenitic stainless steel, which is the most common type of steel for the strip casting process to date, examples of methods of treating the surface of the casting roll include knurling, photo-etching, shot blasting, and laser processing. The roughened surface, resulting from the above process, is featured in that it is formed in the shape of dimples 210, which are fine and independent, as seen in FIG. 2. This shape functions to effectively disperse and eliminate stress accompanied by solidification to thereby prevent the generation of surface cracks in the cast product.

However, in the case where a strip of high Mn steel is manufactured using the casting roll which is imparted with roughness through the above process, small dents 310, which are not observed in other types of steel, are generated in the surface of the cast product, as seen in FIG. 3(*a*).

The reason why the dents 310 are generated is that, in high Mn steel, unlike the other types of steel, Mn, which has a lower melting point and lower vapor pressure to thus be more easily volatilized than the other elements, is contained in an amount of 18~25 wt % in molten steel, and is therefore easily evaporated from the molten steel pool during the casting, such that the resultant vapor gas is fully loaded in a meniscus shield. Further, the vapor gas is deposited on the surface of the casting roll, as well as the inner surface of the meniscus shield. When the vapor gas, which is in a state of being collected in the isolated dimple of the surface of the rotating casting roll, is brought into contact with the molten steel in a liquid phase, expansion or explosion of the gas loaded in the dimple may occur due to high heat transferred from the molten steel. Accordingly, during solidification, an impact is applied to the weak solidification shell, which is in direct contact with the upper surface of such a dimple, undesirably generating the dent 310 by the force of impact. FIG. 3(*b*) is a graph illustrating the number of dents and the dent index when manufacturing a strip of high Mn steel using a conventional casting roll. As shown in this drawing, the case where a cast product of high Mn steel is manufactured using the conventional casting roll results in a large number of dents and a high dent index.

Therefore, with the goal of preventing the generation of undesirable surface dents, there is required a novel dimple forming method, which is quite different from conventional roll surface treatment for a process of casting austenitic stainless steel or general steel to a strip.

DISCLOSURE OF THE INVENTION

Technical Tasks to be Solved by the Invention

Accordingly, the present invention has been made keeping in mind the above problems occurring in the related art, and an object of the present invention is to provide a method of forming a continuous channel for gas discharge in the surface of a casting roll for twin roll strip casting, which allows the collected gas to be effectively discharged from the overall surface of the roll without being isolated, thereby preventing the generation of dents and enabling the manufacture of a cast product having no defects.

Technical Solution

The present invention provides a method of forming a continuous channel for gas discharge on the surface of a casting roll for twin roll strip casting, and more particularly, a method of forming a continuous channel for gas discharge in the surface of a casting roll for twin roll strip casting, suitable for the formation of dimples in the surface of a casting roll for a twin roll strip caster, which includes applying a photoresist on the entire surface of a casting roll, conducting patterning on the applied photoresist, developing the surface of the casting roll, which is subjected to the patterning, and etching the metal surface of the casting roll, exposed in the course of the developing. As such, the continuous channel for gas discharge may be formed to have a width of 150~500 μm and a depth of 50~150 μm.

Advantageous Effects

According to the present invention, the method of forming a continuous channel for gas discharge in the surface of a casting roll for twin roll strip casting is advantageous because a fine continuous channel that is able to effectively discharge vapor gas produced in the molten steel pool in the course of casting is processed in advance in the surface of the roll, thereby preventing the generation of dents corresponding to undesirable surface defects in high Mn steel, enabling the manufacture of a cast product having no defects, and realizing wide applicability not only to high Mn steel but also to types of casting steel capable of causing dents or similar defects due to the generation of a great amount of volatile gas.

BRIEF DESCRIPTION OF DRAWINGS

FIG. 2(*b*) is a schematic view illustrating the shape of the dimple of the surface of a casting roll for twin roll strip casting through conventional shot blasting;

FIG. 2(*c*) is a photograph illustrating the shape of the dimple of the surface of a casting roll for twin roll strip casting through a combination of conventional photo-etching and shot blasting;

FIG. 2(*d*) is a photograph illustrating the shape of the dimple of the surface of a casting roll for twin roll strip casting through a combination of conventional shot blasting and laser processing;

FIG. 3(*b*) is a graph illustrating the dent index of the surface of the high Mn steel cast product manufactured through conventional twin roll strip casting;

FIG. 5(*b*) is a graph illustrating the dimension of the fine continuous channel for gas discharge according to the present invention;

FIG. 5(*c*) is a graph illustrating width and depth of the fine continuous channel for gas discharge according to the present invention.

BEST MODE FOR CARRYING OUT THE INVENTION

Hereinafter, a detailed description will be given of the present invention, with reference to the appended drawings.

Figure 1:
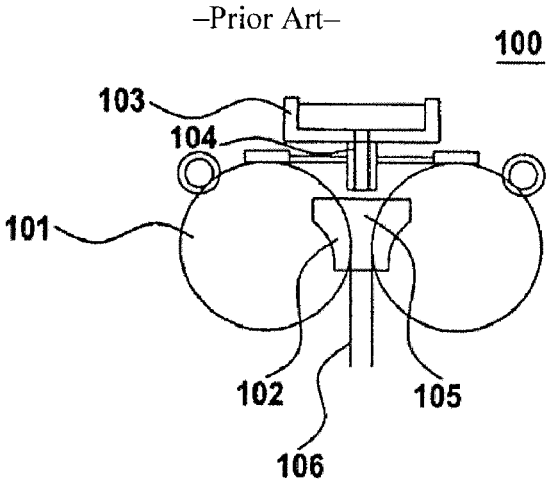
FIG. 1 schematically illustrates a general twin roll strip caster.
Figure 2:
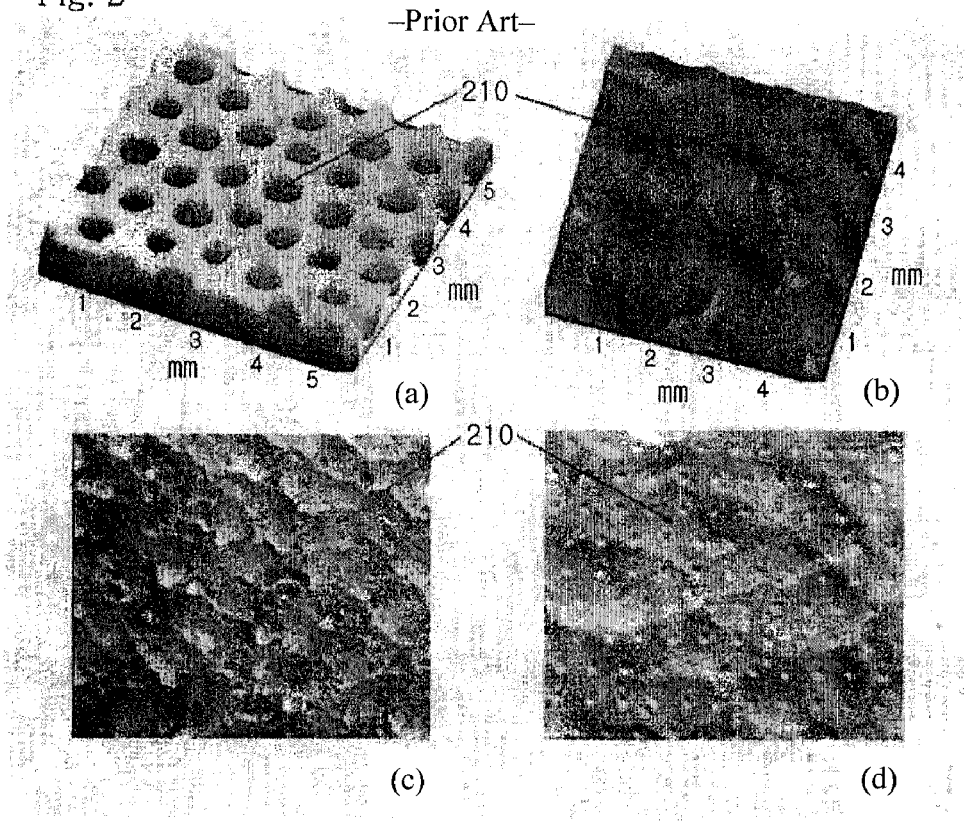
FIG. 2(*a*) is a schematic view illustrating the shape of the dimple of the surface of a casting roll for twin roll strip casting through conventional photo-etching.
Figure 3:
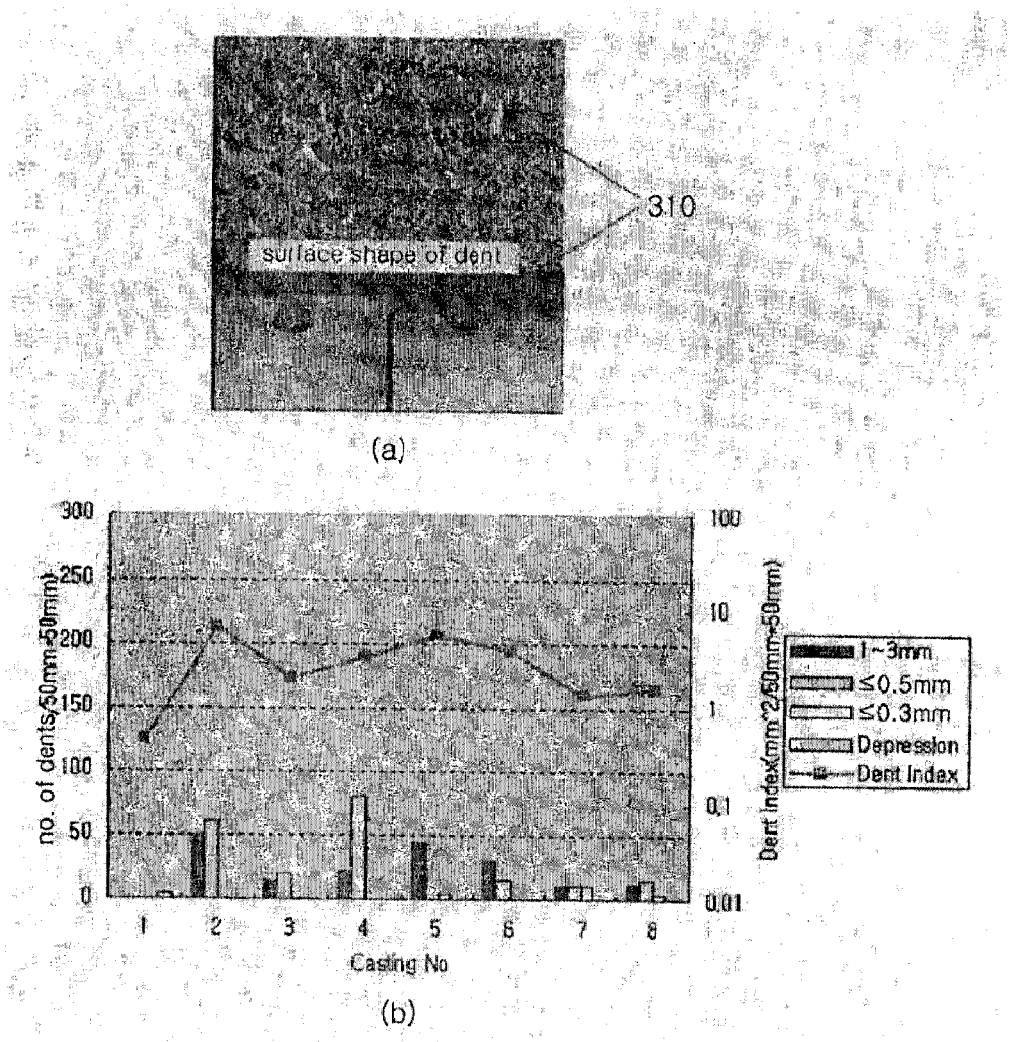
FIG. 3(*a*) is a photograph illustrating the dents in the surface of the high Mn steel cast product manufactured through conventional twin roll strip casting.
Figure 4:
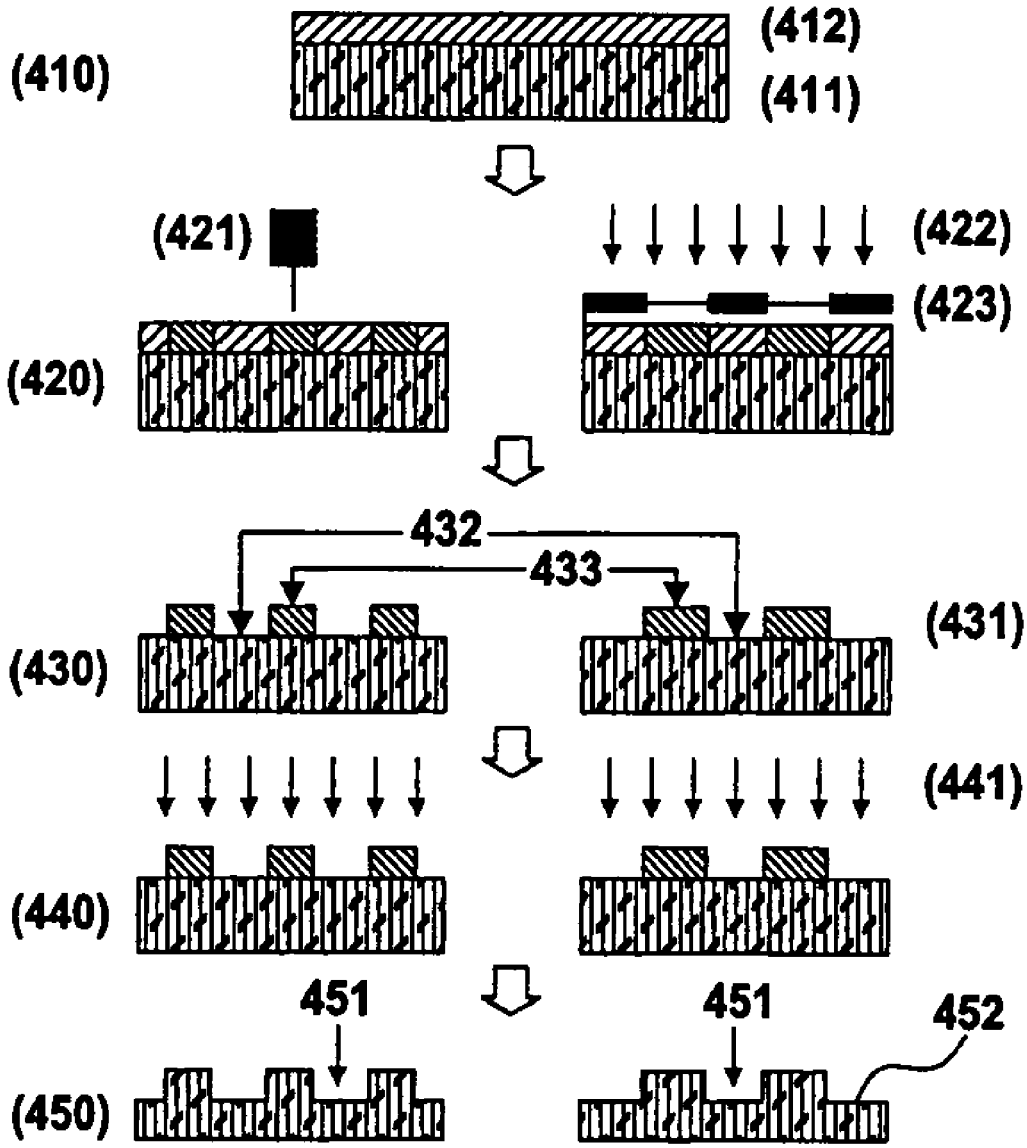
FIG. 4 schematically illustrates the process of treating the surface of the casting roll for forming a continuous channel for gas discharge according to the present invention.

FIG. 4 schematically illustrates the process of treating the surface of the casting roll in order to form a continuous channel for gas discharge according to the present invention.

The process of treating the surface of the casting roll to form a continuous channel for gas discharge includes a series of operations of sensitizing solution application 410, patterning 420, developing 430, etching 440, and dimple formation 450.

The sensitizing solution, that is, a photoresist 412, includes a water-soluble type material and a solvent-soluble type material, and various types of reactions, including crosslinking, decomposition, polymerization, etc., may occur in the molecule thereof in the presence of light. Furthermore, the photoresist is classified into, and made commercially available as, negative and positive types relative to a solvent (a developer). Using such properties, the photoresist may be imaged on the surface, resulting in precise etching products.

In the present invention, a negative photoresist is used, which is more general than a positive photoresist, and is imparted with photosensitivity by adding bichromic acid to protein, shellac, PVA (Poly Vinyl Alcohol), etc. Further, in the present invention, TPR (Thermoplastic Rubber), available from Tokyo Ohka Kogyo Co. Ltd., and having a viscosity of 30 Ps at 25° C., is used.

The thickness of the photoresist 412 which is applied may vary slightly depending on the viscosity of the photoresist 412, and the photoresist 412 may be applied to a thickness of 3~10 μm based on a photoresist having a viscosity of 20~40 Ps.

After the photoresist application 410 for applying the photoresist 412 on the surface of the casting roll 411, drying in a dark room and then patterning 420 are conducted. The patterning method for determining the shape and dimension of a continuous gas channel includes patterning using a laser 421 and radiation of UV light 422 through film masking.

The patterning using the laser 421 is a process of directly radiating laser light onto the dried photoresist 412 to thus photosensitize the photoresist to imprint a desired pattern, and the radiation of UV light 422 through film masking is a process of attaching a masking film 423, which is printed with the shape of the continuous channel 452 to be processed, to the entire surface of the roll, bringing them into close contact, and radiating UV light, thus imprinting a desired pattern in the photoresist 412.

The application of the photoresist 412 and the radiation of the laser 421 or UV light 422 are carried out in a dark room. Because the photoresist 412 reacts with natural light or bright light, the above processes are preferably performed in a dark room, but are typically performed under weak fluorescent light. Further, because the photoresist 412 is highly reactive even under weak light, there are no specific requirements for the intensity of radiation of the laser 421 or the UV light 422.

The masking is an operation of coating the portion of the metal surface, which is intended to be protected from being etched, with a maskant having chemical resistance. The masking film 423 used therefor is a film in which a portion, which is to be etched, and another portion, which is not to be etched but is to be protected, are designed and output in advance. Although this film does not require specific material properties, it should be transparent in order to transmit light therethrough, and should also be brought into close contact with a target surface. In order to increase the degree of contact, it is effective if tension, corresponding to weak force in the extent of elasticity, be applied, and thus the film should be 100~400 μm thick.

After the completion of the patterning, the developing 430 is conducted. In this process, the portion 433 of the photoresist 412, which is cured through photosensitization, acts as a protective film 431, whereas the other portion 432 thereof, which is not cured in response to the non-radiation of light, is dissolved in a basic developer. After the developing, the metal surface of the casting roll 411 is exposed.

That is, the developing 430 is a process of exposing a photoresist to light for a predetermined period of time and then dissolving the portion of the photoresist that is not photosensitized to remove it. As the developer, a dilute ammonia solution, which is weakly alkaline, or about 8% bichromic acid solution, is used.

In the subsequent etching 440, the exposed metal surface, having no protective film, is dissolved in a high-pressure etchant 441 and is thus etched, after which the cured photoresist 412 is removed, resulting in dimples 451.

The type of etchant 441, which plays a role in chemically dissolving out a selected portion, varies depending on target material (e.g., copper, aluminum, carbon steel, stainless steel, nickel/nickel alloy, titanium alloy, etc.), and is appropriately determined. In the present invention, the surface of the roll is formed of nickel, and the etchant 441 includes ferric chloride mixed with an acid as an additive, but the present invention is not limited thereto. An alternative etchant may be used.

Figures 5, 6:
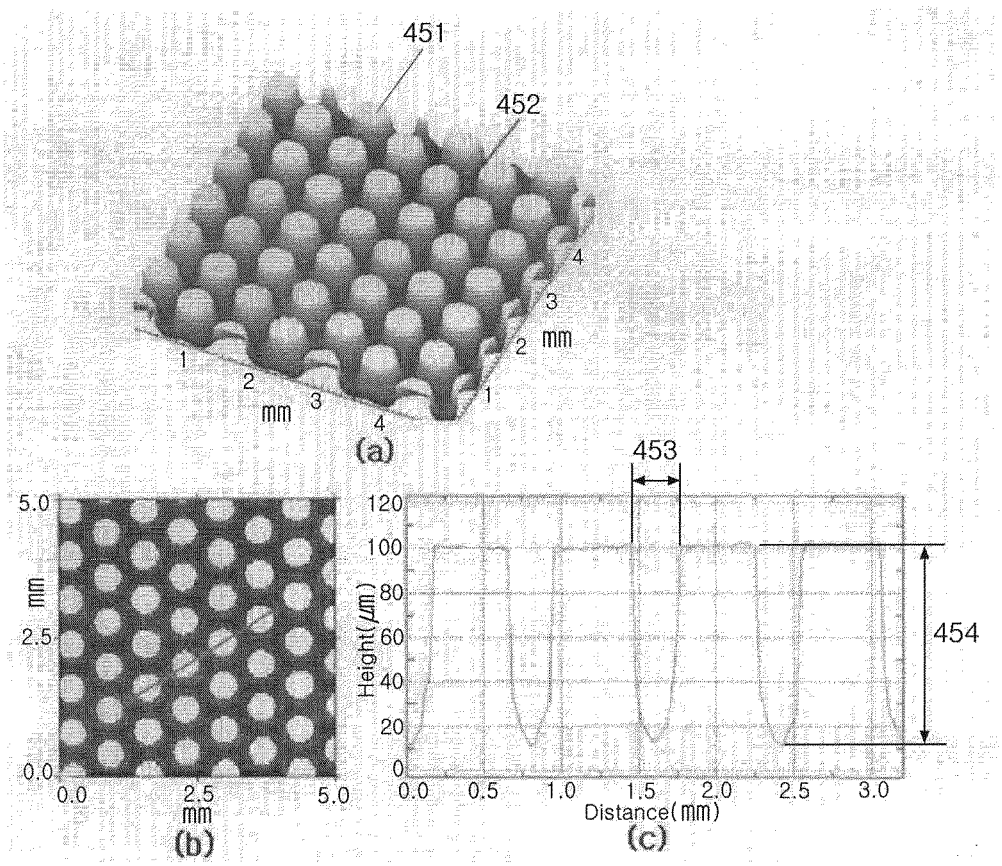
FIG. 5(*a*) is a schematic view illustrating the shape of the surface of the casting roll having a fine continuous channel for gas discharge according to the present invention.
FIG. 6 is a table illustrating the results of comparison of the strip cast using the casting roll having a fine continuous channel for gas discharge according to the present invention and the strip cast using a conventional technique.

FIG. 5(*a*) is a schematic view showing the surface of the casting roll in which a continuous gas channel 452 is processed through the above manufacturing process.

In the example shown in FIG. 5(*a*), the dimple 451 has a diameter of 0.5 mm, a depth of 0.09 mm, a minimum distance between dimples of 0.25 mm, and an area of gas channel of about 42%.

However, such dimensions and areas may vary depending on the composition of high Mn TWIP steel and the casting parameters, and may be further optimized.

In FIGS. 5(*b*) and 5(*c*), the dimension of the continuous gas channel processed through the above manufacturing process is graphed.

The specification of the continuous channel 452 for gas discharge follows.

In the width 453 of the continuous channel 452 for gas discharge, the minimum width is determined to the extent that the continuous channel is maintained in order to effectively discharge the gas. In the strip casting process, because the surface of the casting roll is cleaned using a brush having bristles as an essential tool, the casting roll may be worn by the bristles. Further, to maintain the continuous channel phase even in the course of casting for a long period of time, the continuous channel should have at least a predetermined width. The minimum width is set to 150~200 μm.

When the molten steel is loaded in the continuous channel 452 for gas discharge, the surface of the casting material may be uneven, which causes surface defects in the course of post-treatment. In the width 453 of the continuous channel 452 for gas discharge, the maximum width is determined such that the molten steel can not easily infiltrate, or the amount of the molten steel is very low in the case where the molten steel infiltrates. Generally, when a clearance has a size smaller than a certain size, molten steel cannot infiltrate into the clearance due to surface tension. This phenomenon may be affected by the components of the molten steel and by other parameters including temperature. In the strip casting process, in order to manufacture high Mn TWIP steel containing 18~25% Mn, the maximum width of the continuous channel 452 for gas discharge is set to 400~500 μm.

The depth 454 of the continuous channel 452 for gas discharge need not be set at a large value, as long as the continuous channel may be maintained. Because the dimple and the gas channel are inevitably worn at the same time as the casting is conducted through brushing, the continuous channel should be as deep as required to last for a roll replacement period, at a minimum. The appropriate depth thereof is set to 50~150 μm.

In the patterning process of the present invention, the shape and the dimension of the gas channel may be selectively controlled, and hence, the continuous channel 452 for gas discharge optimal for the casting of high Mn steel may be freely processed.

The density of the continuous channel 452 for gas discharge of each of the central portion and the edge portion of the roll may be the same or different, as needed. This is because the continuous channel 452 for gas discharge is a portion that is difficult to bring into direct contact with the molten metal, and thus has a lower cooling rate than the other portions (including close contact portions). Therefore, when there is a need for controlling the cooling performance of the roll in a width direction, it may be effective to change the density of the continuous channel 452 for gas discharge.

As is apparent from the table of FIG. 6, the case where the strip is cast using the casting roll having the fine continuous channel for gas discharge according to the present invention is compared with the case where the strip is cast using conventional techniques.

In the case where the independent dimples were formed through various roll surface treatment methods, that is, photoetching, shot blasting, laser processing, and combinations thereof, the degree of generation of dents was slightly different in respective processes, but the generation of dents was not completely prevented in any of the examples.

However, in the case where the strip was cast using the casting roll having the fine continuous channel according to the present invention, no dents were generated by the expansion or explosion of the collected vapor gas, which confirms that the collected vapor gas was effectively discharged through the continuous channel.

Therefore, through inverse dimple etching, having a shape opposite the shape of typical dimple etching, using the photoetching and laser patterning etching of the present invention, the fine continuous channel was formed, thereby effectively discharging volatile vapor gas, occurring when casting high Mn steel, consequently preventing the generation of dents corresponding to undesirable surface defects.

INDUSTRIAL APPLICABILITY

As described above, the prevent invention provides a method of forming a continuous channel for gas discharge in the surface of a casting roll for twin roll strip casting, which allows the collected gas to be effectively discharged from the entire surface of the roll without being isolated, thus preventing the generation of dents and enabling the manufacture of a cast sample having no defects.

The invention claimed is:

1. A method of forming a continuous channel for gas discharge on a surface of a casting roll for twin roll strip casting of high Mn steel containing 18-25 wt % Mn without generation of dents, comprising:

photoresist application, including applying a negative photoresist imparted with photosensitivity by adding bichromic acid to protein, shellac, or Poly Vinyl Alcohol and with a thickness of 3-10 μm based on a photoresist having a viscosity of 20-40 Ps on an entire surface of a casting roll for twin roll strip casting of high Mn steel containing 18-25 wt % Mn and then conducting drying in a dark room;

patterning, including attaching a film, which is printed with a shape of a continuous channel for gas discharge, to the entire surface of the casting roll and then radiating UV light onto the applied photoresist in a dark room, but under weak fluorescent light, or directly radiating laser onto the dried photoresist in a dark room, but under weak fluorescent light, thus forming the shape of the continuous channel for gas discharge;

developing, including exposing the surface of the casting roll, which is subjected to the patterning, to light, and then dissolving a portion of the photoresist, which is not photosensitized, using a dilute ammonia solution, which is weakly alkaline, or a 8% bichromic acid solution, to thus remove it; and etching, including etching a metal surface of the casting roll, exposed in the developing, thus forming the continuous channel for gas discharge, wherein the continuous channel for gas discharge on a surface of a casting roll for twin strip roll casting of high Mn steel containing 18-25 wt % Mn is formed to have a width from 400 μm to 500 μm and a depth from 50 μm to 150 μm.

* * * * *